United States Patent [19]

Sueki et al.

[11] Patent Number: 4,620,896

[45] Date of Patent: Nov. 4, 1986

[54] SINGLE FACER HAVING TWO SETS OF CORRUGATING ROLLS AND A SINGLE PRESSURE ROLL

[75] Inventors: Hiroshi Sueki; Kuniaki Yufu, both of Amagasaki, Japan

[73] Assignee: Rengo Co., Ltd., Osaka, Japan

[21] Appl. No.: 806,751

[22] Filed: Dec. 9, 1985

[30] Foreign Application Priority Data

Dec. 14, 1984 [JP] Japan ..... 59-264164

[51] Int. Cl.[4] ..... B31F 1/24

[52] U.S. Cl. ..... 156/471; 156/205; 156/578; 425/369; 425/396

[58] Field of Search ..... 156/205, 578, 470–474; 425/369, 396

[56] References Cited

U.S. PATENT DOCUMENTS

| | | | |
|---|---|---|---|
| 1,180,828 | 4/1916 | Crane | 156/472 |
| 3,455,767 | 7/1969 | Meister | 156/470 |
| 3,556,907 | 1/1971 | Nystrand | 156/470 |
| 4,569,714 | 2/1986 | Tokumo | 156/471 |

FOREIGN PATENT DOCUMENTS

| | | | |
|---|---|---|---|
| 901255 | 1/1954 | Fed. Rep. of Germany | 156/472 |
| 255769 | 3/1970 | U.S.S.R. | 425/369 |

*Primary Examiner*—Jerome Massie

*Attorney, Agent, or Firm*—John F. A. Earley; John F. A. Earley, III

[57] ABSTRACT

A single facer comprising plural means for corrugating and pasting sheet medium and a pressure roll, characterized in that each pair of upper and lower corrugating rolls are capable of being moved so that the lower corrugating roll may be brought into contact with the pressure roll.

3 Claims, 2 Drawing Figures

SINGLE FACER HAVING TWO SETS OF CORRUGATING ROLLS AND A SINGLE PRESSURE ROLL

This invention relates to a single facer adapted to be capable of manufacturing plural kinds of flute single-faced corrugated board.

One of the prior art single facers of this kind is disclosed by U.S. Pat. No. 3,455,767. The single facer machine according to the U.S. patent is provided with two single facer units each comprising an upper corrugating roll, a lower corrugating roll meshing with said upper corrugating roll to form a nip for receiving a sheet medium to corrugate the same, means for applying adhesive to the peaks of the flutes of the corrugated medium and a pressure roll for pressing a sheet linerboard against the corrugated medium after the adhesive has been applied, to bond the linerboard to the corrugated medium. The single facer machine can freely manufacture two kinds of flute single-faced corrugated board, provided that the two pairs of corrugating rolls have been made different in the shape or size of flutes or corrugations. However, such a single facer machine can't be incorporated in the line of corrugator provision being already constructed, and manufacturing cost of the machine is high because of its large construction.

An object of the present invention is to provide a single facer which is adapted to be capable of manufacturing plural kinds of flute single-faced corrugated board and of being incorporated in the provision being already constructed, and which can be produced at a low price because of being relatively small-sized.

Other objects of the invention will become more readily apparent from the following description and the accompanying drawings.

In accordance with the above-mentioned object, the present invention provides a single facer comprising (a) plural means for corrugating and pasting sheet medium, said means each including an upper corrugating roll, a lower corrugating roll meshing with said upper corrugating roll to form a nip for receiving a sheet medium to corrugate the same and means for applying adhesive to the peaks of the flutes of the corrugated medium, and (b) a pressure roll, characterized in that said upper and lower corrugating rolls are capable of being moved so that the lower corrugating roll may be brought into contact with said pressure roll to push the corrugated medium to which the adhesive has been applied, against a sheet linerboard extending around the pressure roll to bond the corrugated medium to the linerboard.

The invention will be explained with reference to embodiments shown in the accompanying drawings, in which.

Figure 1:
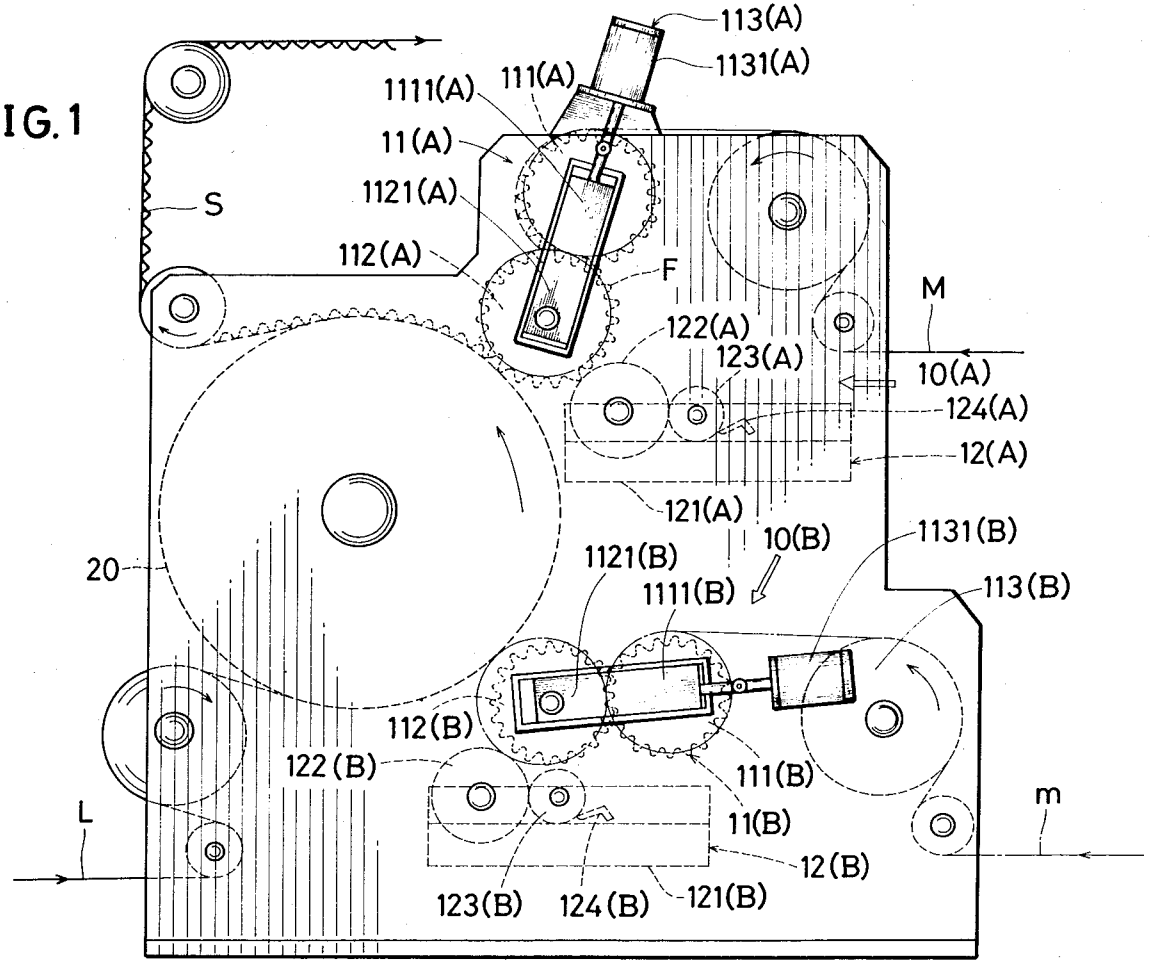
FIG. 1 is a side view showing an embodiment of the invention.

Referring to the embodiment shown in FIG. 1, the present invention will be explained in detail.

Reference numeral 10(A) indicates a means for corrugating and pasting a sheet medium, and the means 10(A) comprise corrugation means 11(A) and means 12(A) for applying adhesive. The corrugation means 11(A) comprise an upper corrugating roll 111(A), a lower corrugating roll 112(A) meshing with the upper corrugating roll 111(A), said upper and lower corrugating rolls being capable of making the corrugation of A-flute, and a moving device 113(A) adapted to move respective pairs of journal bearings 1111(A) and 1121(A) of the upper and lower corrugating rolls 111(A) and 112(A) by means of a pair of air-cylinders 1131(A). The means 12(A) for applying adhesive comprise an adhesive pan 121(A), an adhesive roll 122(A) adapted to come in contact with the lower corrugating roll 112(A), a doctor roll 123(A) and a doctor knife 124(A).

Reference numeral 10(B) indicates a means for corrugating and pasting a sheet medium, and the means 10(B) comprise corrugation means 11(B) and means 12(B) for applying adhesive. The corrugation means 11(B) comprise an upper corrugating roll 111(B), a lower corrugating roll 112(B) meshing with the upper corrugating roll 111(B), said upper and lower corrugating rolls being capable of making the corrugation of B-flute, and a moving device 113(B) adapted to move respective pairs of journal bearings 1111(B) and 1121(B) of the upper and lower corrugating rolls 111(B) and 112(B) by means of a pair of air-cylinders 1131(B). The means 12(B) for applying adhesive comprise an adhesive pan 121(B), an adhesive roll 122(B) adapted to come in contact with the lower corrugating roll 112(B), a doctor roll 123(B) and a doctor knife 124(B).

Reference numeral 20 indicates a pressure roll, the outer diameter of which is larger than those of conventional pressure rolls.

The following operation is carried out to manufacture A-flute single-faced corrugated board S:

In order that a linerboard L extending around the pressure roll 20 and A-flute corrugated medium M fed by the lower corrugating roll 112(A) of the corrugation means 11(A) may be bonded together, the lower corrugating roll 112(A) is pushed against the pressure roll 20, while the lower corrugating roll 112(B) of the corrugation means 11(B) is parted from the pressure roll 20. The adhesive roll 122(A) of the means 12(A) for applying adhesive is adjusted so that the adhesive roll 122(A) may come in contact with the peaks F of the flutes of a corrugated medium kept on the corrugations of the lower corrugating roll 112(A). After the preparation as mentioned above, the lower corrugating roll 112(A) of the corrugation means 11(A), the adhesive roll 122(A) of the means 12(A) for applying adhesive and the pressure roll 20 are drivingly rotated. Thus, A-flute single-faced corrugated board S is continuously manufactured. If B-flute single-faced corrugated board is to be manufactured, the lower corrugating roll 112(A) of the corrugation means 11(A) is parted from the pressure roll 20, while the lower corrugating roll 112(B) is pushed against the pressure roll 20 so that a linerboard L extending around the pressure roll 20 and a corrugated medium m to be fed by the lower corrugating roll 112(B) of the corrugation means 11(B) may be bonded together. Subsequently, the same operation as explained in the foregoing for manufacturing A-flute single-faced corrugated board is carried out.

Figure 2:
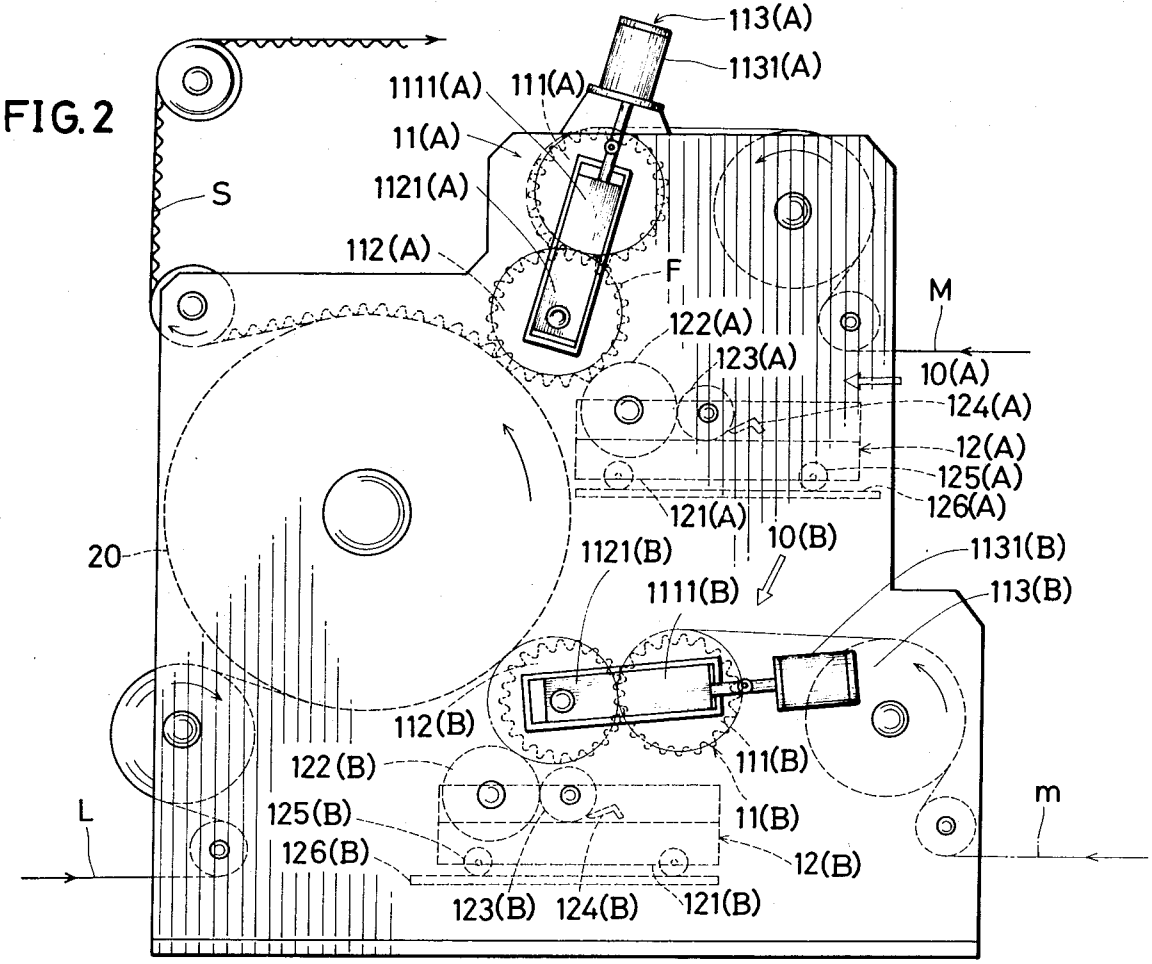
FIG. 2 is a side view showing another embodiment of the invention.

Another embodiment of the invention is shown in FIG. 2. Construction of the embodiment is the same as that of the embodiment shown in FIG. 1, with the exception of that means 12(A) for applying adhesive are capable of being moved on a pair of rails 126(A) by means of rollers 125(A), and that means 12(B) for applying adhesive are capable of being moved on a pair of rails 126(B) by means of rollers 125(B). Accordingly, further explanation will be omitted.

In the single facer according to the present invention the outer diameter of the pressure roll, the inside of which is heated, can be enlarged, so the pressure roll can have high heating effect. Accordingly, adhesion between the linerboard and the corrugated medium can be quickly and completely done.

What is claimed is:

1. A single facer comprising (a) plural means for corrugating and pasting sheet medium, said means each including an upper corrugating roll, a lower corrugating roll meshing with said upper corrugating roll to form a nip for receiving a sheet medium to corrugate the same and means for applying adhesive to the peaks of the flutes of the corrugated medium, and (b) a pressure roll, characterized in that said upper and lower corrugating rolls are capable of being moved so that the lower corrugating roll may be brought into contact with said pressure roll to push the corrugated medium, to which the adhesive has been applied, against a sheet linerboard extending around the pressure roll to bond the corrugated medium to the linerboard.

2. A single facer as claimed in claim 1, wherein said upper and lower corrugating rolls are moved by means of a pair of air-cylinders.

3. A single facer as claimed in claim 1 or 2, wherein said means for applying adhesive are capable of being moved.

* * * * *